United States Patent [19]

Dupuy

[11] Patent Number: 4,713,046

[45] Date of Patent: Dec. 15, 1987

[54] CIRCULAR MACHINE FOR AUTOMATIC MANUFACTURING OF DISPLAY BOXES

[75] Inventor: Francois Dupuy, Dignac, France

[73] Assignee: Dupuy Engineering, S.A., L'Isle D'Espagnac, France

[21] Appl. No.: 15,527

[22] Filed: Feb. 13, 1987

Related U.S. Application Data

[63] Continuation of Ser. No. 476,346, Mar. 17, 1983, abandoned.

[30] Foreign Application Priority Data

Mar. 18, 1982 [FR] France ..... 82 04579
Feb. 24, 1983 [FR] France ..... 83 02985

[51] Int. Cl.[4] ..... B31B 1/60
[52] U.S. Cl. ..... 493/6; 493/379; 493/388; 493/905
[58] Field of Search ..... 206/45.31, 45.34; 493/6, 379, 388, 905

[56] References Cited

U.S. PATENT DOCUMENTS 3,964,953 6/1976 Mitchard et al. ..... 493/379

FOREIGN PATENT DOCUMENTS 1082794 6/1960 Fed. Rep. of Germany .
1561429 1/1971 Fed. Rep. of Germany .

*Primary Examiner*—W. Donald Bray
*Attorney, Agent, or Firm*—Brisebois & Kruger

[57] ABSTRACT

The invention relates to the Cardboard Industry. More specially it relates to a machine for manufacturing of display packages of the type comprising an opening straddling at least one edge and which is closed by a stiff, transparent sheet of plastic material. The device according the present invention comprises a horizontal circular plate, a plurality of work stations which feed the suction boxes positioned on the said plate which permit to move the blanks from one of the work stations to the other. It comprises at least stations for the cardboard blanks, for the plastic blanks, for the coating of the blanks, for the sealing and/or grooving of the plastic blanks and for picking up the assembled blanks.

11 Claims, 14 Drawing Figures

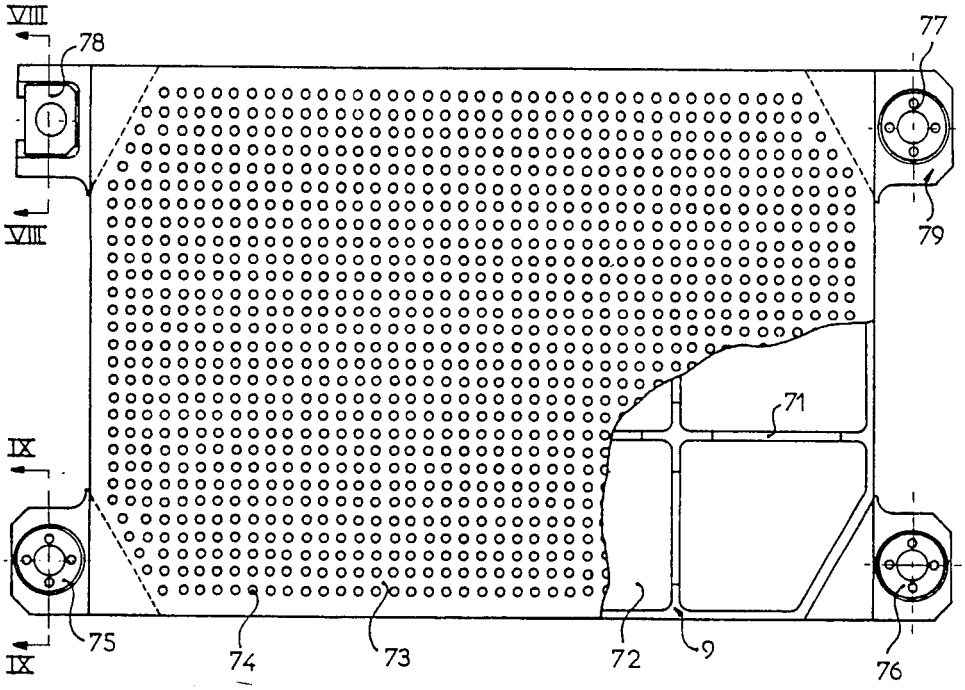
Fig.7
Fig.8
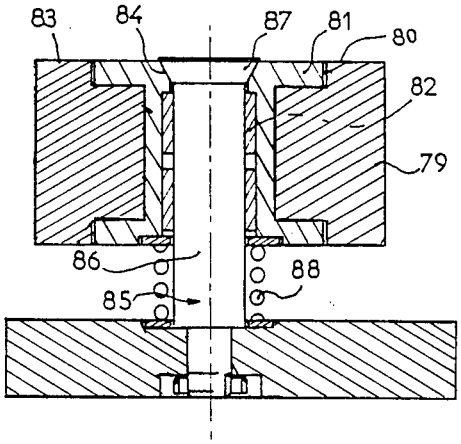
Fig.9
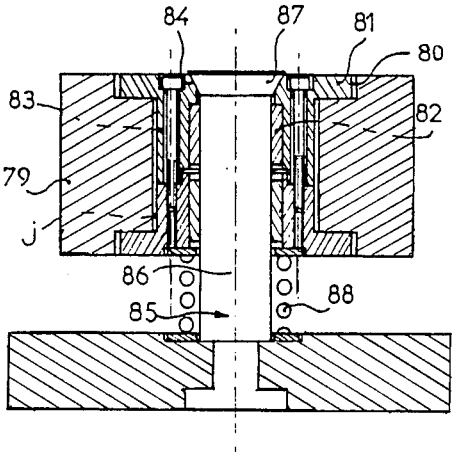

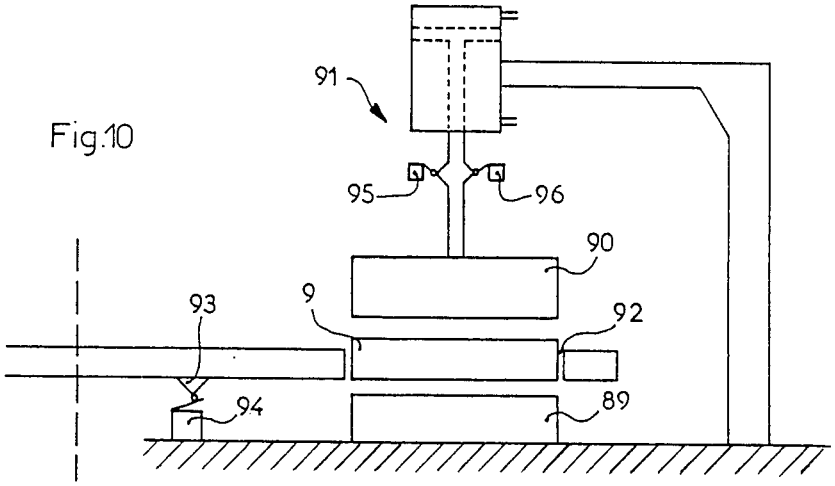
Fig.10
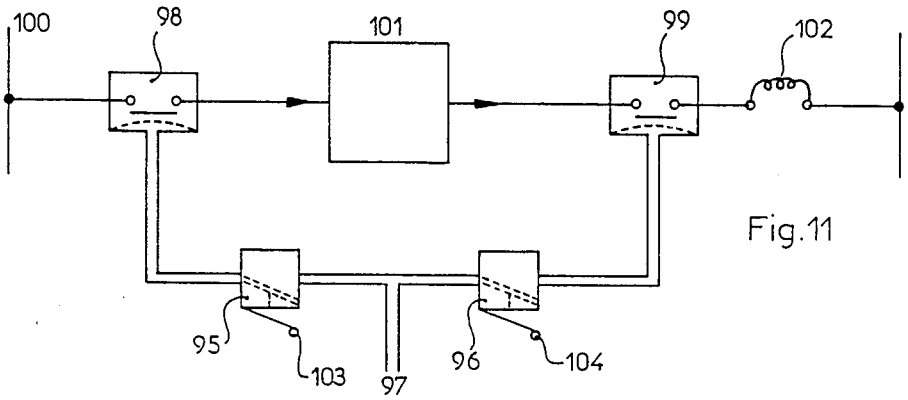
Fig.11
Fig.12
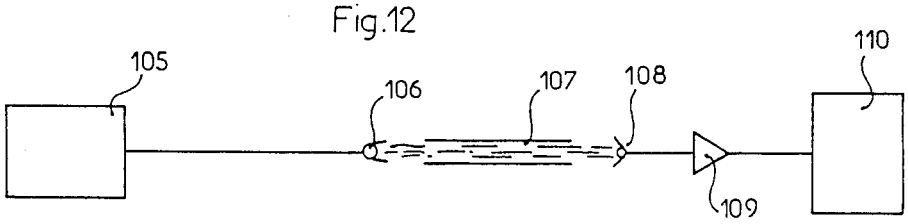

CIRCULAR MACHINE FOR AUTOMATIC MANUFACTURING OF DISPLAY BOXES

This application is a continuation of application Ser. No. 476,346, filed Mar. 17, 1983, and now abandoned.

BACKGROUND OF THE INVENTION

The present invention relates to a device for assembling cardboard blanks and blanks of plastic material, particularly for making display packages of the type comprising an opening or window straddling at least one edge or corner of the package and which is closed by a stiff, transparent sheet of plastic material having cut-outs or notches at the ends of its folding lines. Such display packages and their method of making are already described in U.S. Application 329,335, filed Dec. 10, 1981 and the corresponding French Patent Application No. 80 26 305 of Dec. 11, 1980 and its Patent of Addition No. 81 13 025 of July 2, 1981.

The U.S. application (and the French Patent Applications) relate to a method and apparatus where a blank of pre-grooved plastic material is placed onto a pre-cut cardboard blank which has previously been coated by an adhesive material. The application of this technique has proved to be difficult and costly. As a matter of fact, it requires a positioning or alignment which must be extremely accurate for the plastic blank relative to the blank or sheet of cardboard.

The U.S. application also discloses an assembling method according to which the grooving of the blank of plastic material is performed after the sealing or adhering of that blank with the cardboard blank. This grooving can also be carried out at the same time as the sealing of the plastic blank, and preferably, by a high frequency press.

SUMMARY OF THE INVENTION

It is an object of the present invention to provide an automatic apparatus for carrying out the method which was described last and which is disclosed in the U.S. application and the Patent of Addition Application.

The device according to the present invention comprises a horizontal circular plate or table which is movable around a vertical axis, a plurality of suction boxes mounted on said plate, connected with a vacuum source and adapted to receive the blanks to be assembled, a plurality of work stations arranged around said plate in predetermined angular positions and which comprise: at least, a feeding station for the cardboard blanks; a feeding station for the plastic blanks; a checking station for verifying the presence of blanks on the suction boxes; a high frequency sealing station for attaching the plastic blanks to the cardboard blanks; a receiving station for picking up the assembled blanks from the suction boxes; and, control means for assuring an intermittent angular displacement of the plate for moving the suction boxes from one work station to the next and for operating the apparatus at each of said stations after each angular displacement of the plate.

The subject device makes sure that the cardboard blank is first placed on a suction box. Then the suction box is advanced to the feeding station for the plastic blanks by indexing the circular plate. A plastic blank is precisely positioned on the cardboard blank and held in position by the suction of the box which is effective through the window opening or openings of the cardboard blank. At the same time another cardboard blank is placed onto the following suction box on the circular plate.

During the subsequent operations, especially the grooving and sealing of the plastic blank, the position of the plastic blank relative to the cardboard blank is perfectly maintained, and no additional adjustment is required. In addition, a less cumbersome device which operates continuously without any unused return movements, is provided due to the arrangement of the suction boxes on a table or circular plate.

Furthermore, according to the invention the feeding station for both the cardboard and plastic blanks includes a structure which is positioned radially with respect to the circular plate and which partially lies above the plate; a vertically movable support plate on the structure for supporting a stack of blanks; a frame movably mounted on radial rails at the upper end of the structure and which can be moved from a first or outer radial position in which it lies above the support plate, to a second or inner radial position in which it lies above a suction box on the circular plate; a plurality of suction pick-up heads mounted on crossbars of the movable frame and which are connected to a vacuum source; and control means to move the frame or the crossbars to a lowered position for picking up a blank from a stack and depositing the blank on the suction box, and to an elevated position during transfer movement of said frame between the inner and outer positioning.

The receiving station for the assembled blanks is substantially the same as a feeding station, except the assembled blanks are picked up from the suction box on the circular plate and are deposited on a stack on the radially outwardly disposed support plate.

These stations include relatively simple and easily operable mechanisms. The picking up and depositing of the blanks by the suction pick-up heads mounted on the movable frame allows exact placing of the blanks onto the suction boxes. Such a feeding station is particularly advantageous for the handling of sheet cardboard blanks having a plurality of openings for the simultaneous assembling of several packages which are then cut or separated from each other as described in the above-cited U.S. application and Patent of Addition.

The feeding of individual plastic blanks requires a higher degree of accuracy.

To achieve this, the feeding station for plastic blanks comprises, according to a preferred embodiment of the invention, a removable support board adapted to be placed onto a fixed support plate and which carries a plurality of vertical guide means between which said blanks are placed on the vertically movable support plate which is mounted on vertically movable small boards, with the section and the arrangement of the guide means being such that the blanks are guided along their cut-outs, an upper fixed plate being positioned above the movable support plate and below the movable frame carrying the suction heads, and carrying a plurality of fixed guide means whose section and arrangement correspond to those of the vertical guide means, and the upper fixed plate having a suitable opening for upward passing of said blanks when they are picked up by the suction heads.

In this manner a very accurate guiding and positioning of the plastic blanks is attained. This guiding system is simple and can easily be modified in accordance with the dimensions and configurations of the blanks to be fed.

To avoid simultaneous pick-up of several blanks from a pile, the fixed guiding means comprise, according to the invention, near their upper ends and on their guiding surface a plurality of apertures or perforations which are connected with a source of compressed air.

Such a feeding station can also be utilized when it is desired to deposit at the same time several individual cardboard blanks which form a single package. In this case the guide means lie in the corners of the openings in the blanks.

According to a particularly advantageous embodiment of the device according to the invention, the sealing and/or grooving station comprises a high frequency press having a fixed jaw arranged below the circular plate or table and a movable jaw arranged above the plate, with the suction boxes being supported relative to said plate by slide bearings cooperating with vertical posts or pins provided on the plate and which have elastic return means for normally maintaining the upper faces of boxes at a predetermined distance above the plate. The body of each box extends into an opening in the table to allow the box to be moved downwardly, against the action of the elastic return means by the movable jaw of the press, so the body of the box extends through the opening, and the bottom of the box seats on the fixed jaw.

Preferably, the hearings and pins have interior cylindrical portions between which a deformable elastic bushing is provided. The heads of the pins are conical and the bearings have conical recesses, to precisely align the box on the pins in its upper position.

Due to this arrangement, the expansion of the boxes under the effect of the heat released by the high frequency press is compensated for. In addition, it is assured that the boxes are moved exactly parallel between the two jaws of the press.

For sealing and grooving the plastic blanks it is also possible to provide two separate high frequency presses, arranged at two successive work stations.

Furthermore, in order to avoid disturbing the automatic control arrangement according to the invention, by magnetic fields caused by operatng the press and to electrically isolate the press from the control means for indexing the table, the starting of the press is controlled by an electronic-optical barrier. Mounted on the press are two valves connected between a source of compressed air and two pressostats in the electrical control circuit of the driving means for the table. These valves permit the table driving circuit to start only when the movable jaw of the press is in its upper position.

In order to prevent damage to the press and the boxes when it just so happens that the boxes are not aligned vertically with the press, the table has between each pair of boxes a cam, cooperating with a stationary switch in the control circuit of the press, and whose actuation by the cam causes the press circuit to open with displacement into the upper position of the movable jaw of the press.

In order to assure in such a device a suitable high frequency sealing between the cardboard blanks and the blanks of rigid plastic, it is normally necessary to first coat one of the blanks with a liquid facilitating this sealing. This operation is usually carried out in two separate steps on a special machine and thus constitutes a costly preliminary treatment, involving additional handling of the blanks.

To obviate this shortcoming, the device according to the invention comprises, in addition, downstream of the feeding station of the cardboard blanks or the feeding station of the plastic blanks, a coating station to deposit either on the cardboard blanks or on the plastic blanks a liquid which facilitates the high frequency sealing of the blanks together and which comprises means for depositing said coating liquid onto the blanks along the sealing lines between the cardboard blanks and the plastic blanks.

Preferably, said coating liquid is composed of an aqueous dispersion of polyacrylic esters of the copolymeric polyvinyl acetate type with 5% solvent. Such a coating liquid allows a one-step treatment. But it is also possible to use vinyl glues as a coating liquid.

According to a particularly advantageous embodiment, said coating station comprises a container at a constant elevation which contains the coating liquid and is arranged radially outwardly of the circular plate or table opposite a suction box of the latter, a lower frame, provided on its upper surface with fibers whose configuration or pattern corresponds to the pattern of the sealing lines between the cardboard blanks and the plastic blanks, and which is vertically movable between a lower position in which it lies in said container and the fibers are below the level of the coating liquid in the container, and an upper position in which the fibers are above the level of the coating liquid in the container. There is an upper frame carrying on its lower surfaces strips of a pliable and absorbing material, following the envisaged sealing lines and which is movably mounted in a horizontal plane radially relative to the table between an outer position in which it lies above the lower frame and an inner position in which it lies above the suction box on the table in alignment with the cardboard blank positioned on the suction box, with the upper frame being provided with control means to move it to the inner position and to the outer position while in an elevated upper position in which it lies above the lower frame and the suction box, and to a lower position in which it receives the glue stripes from the hollow fibers of the lower frame or applies the glue stripes on the cardboard blank positioned on a suction box.

According to a preferred embodiment, said control means of the upper frame is a jack or cylinder whose shaft carries a slide block which can be advanced through an opening in the blank to be coated, to hold it on the suction box of the table. In this manner a perfect positioning of the blanks is assured at the time of coating.

The coating liquid can either be applied on the cardboard blank or on the plastic blank. When high frequency grooving is carried out at the same station, the coating liquid must be deposited onto the plastic blank.

BRIEF DESCRIPTION OF THE DRAWINGS

Other embodiments and advantages of the invention will become apparent by referring to the following decription and attached drawings which show an example of the preferred embodiments according to the invention.

FIG. 7 is a plan view with portions cut away, of a suction box on the circular plate or table of FIG. 1;

FIG. 8 is a sectional view along the line VIII—VIII of FIG. 7;

FIG. 9 is a sectional view along the line IX—IX of FIG. 7;

FIG. 10 is a schematic view in section of the high frequency sealing and/or grooving station;

FIG. 11 shows the electrical control circuit for the circular plate or table;

FIG. 12 shows schematically the control and starting circuit of the high frequency press;

DESCRIPTION OF THE PREFERRED EMBODIMENT

Figure 1:
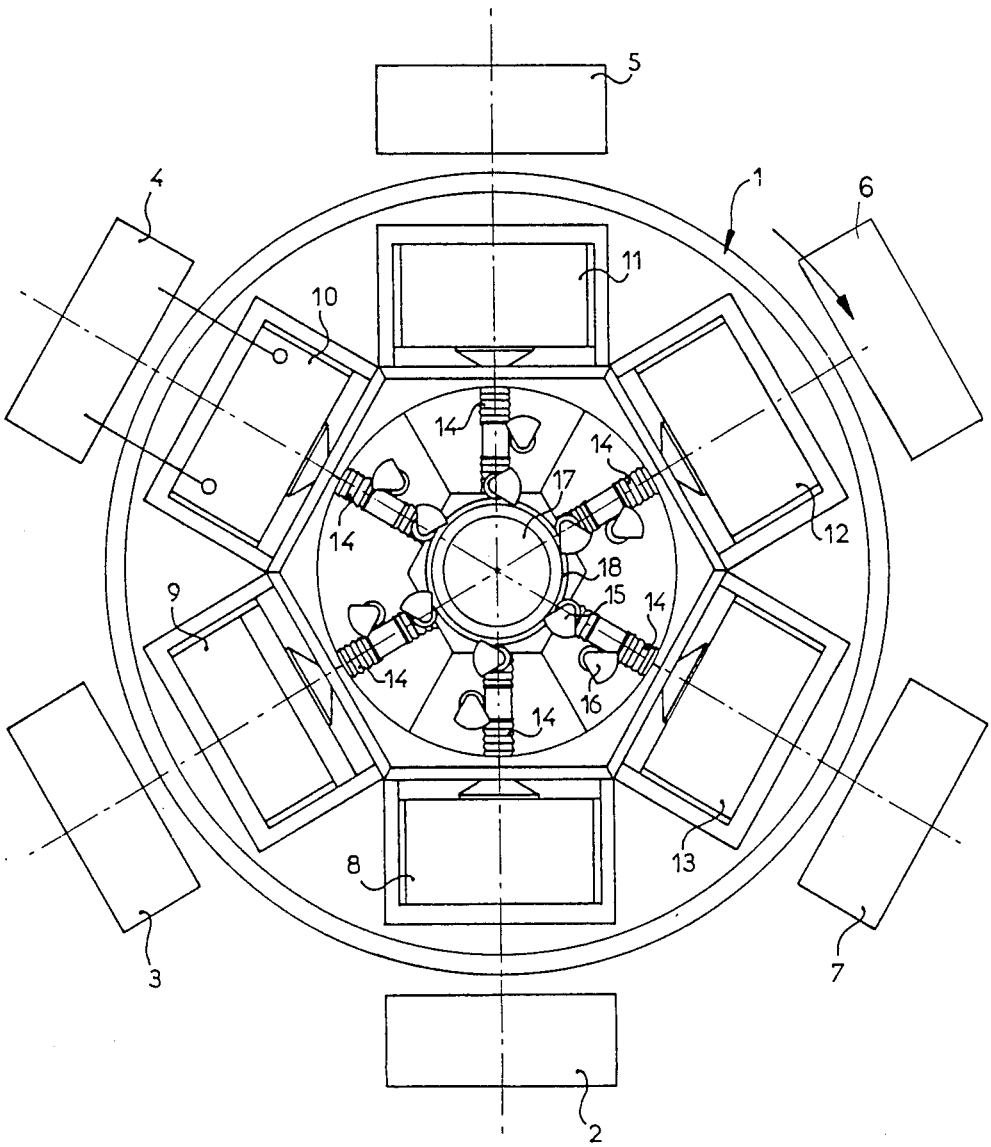
FIG. 1 is a schematic plan view of an apparatus according to the invention.

The apparatus according to the invention as shown in FIG. 1 comprises a horizontal circular plate or table 1 which is rotatively driven by a known motor and transmission. These means assure an intermittent angular displacement of the plate 1 of a predetermined angular distance corresponding to the distance between two adjacent work stations, arranged opposite the plate.

In the embodiment described here, the device comprises six work stations equally spaced circumferentially around the plate 1. These work stations comprise a station 2 for the feeding of cardboard blanks, a station 3 for the feeding of plastic blanks, a checking station 4, a sealing station 5, and a second checking station 6 and a receiving or discharge station 7 at which the assembled blanks are removed from the circular plate 1.

Six suction boxes 8, 9, 10, 11, 12 and 13, one of which is shown in detail in FIGS. 7 to 9, are mounted on circular plate 1, one opposite each of the work stations. Each suction box is connected by a flexible conduit 14 and across an input valve 15 and and output valve 16 to a central vacuum source 17, not shown here in detail. Between the conduits 14 and the vacuum source 17 are provided, in a known manner, rotating joints 18. The control means for the valves 15 and 16 will be described later.

Figure 2:
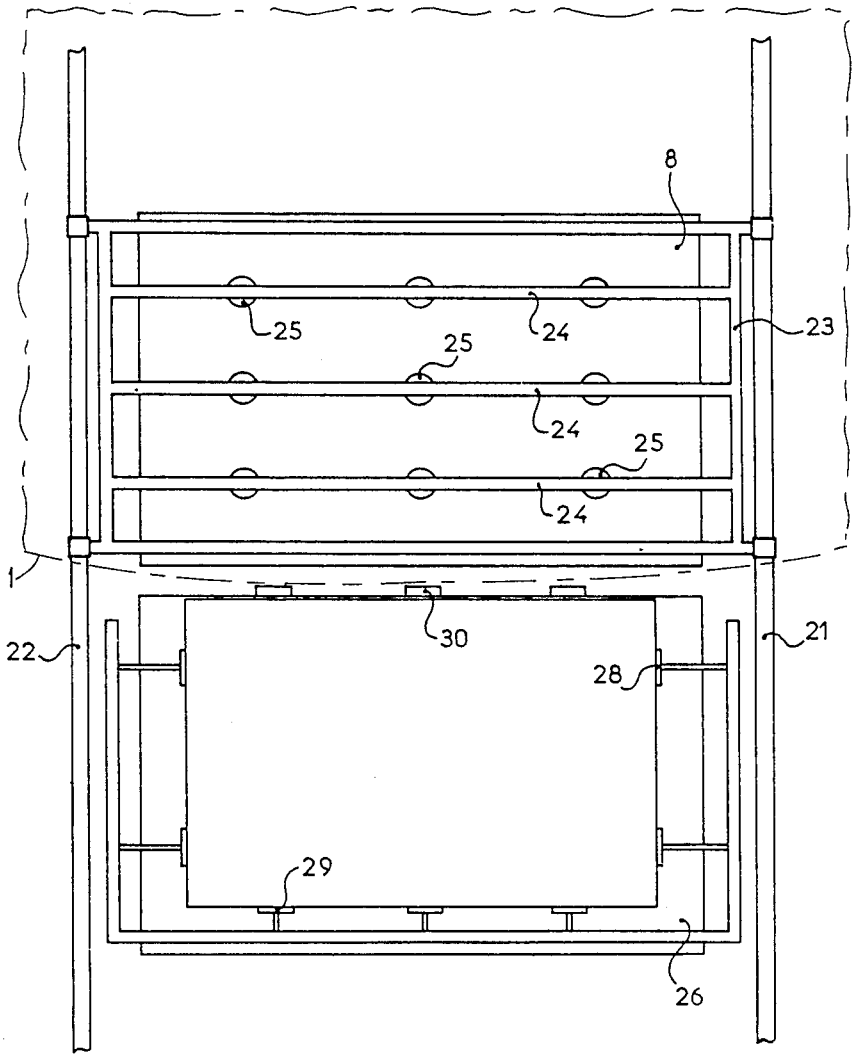
FIG. 2 is a very schematic plan view of the feeding and receiving stations for sheets or blanks of cardboard.
Figure 3:
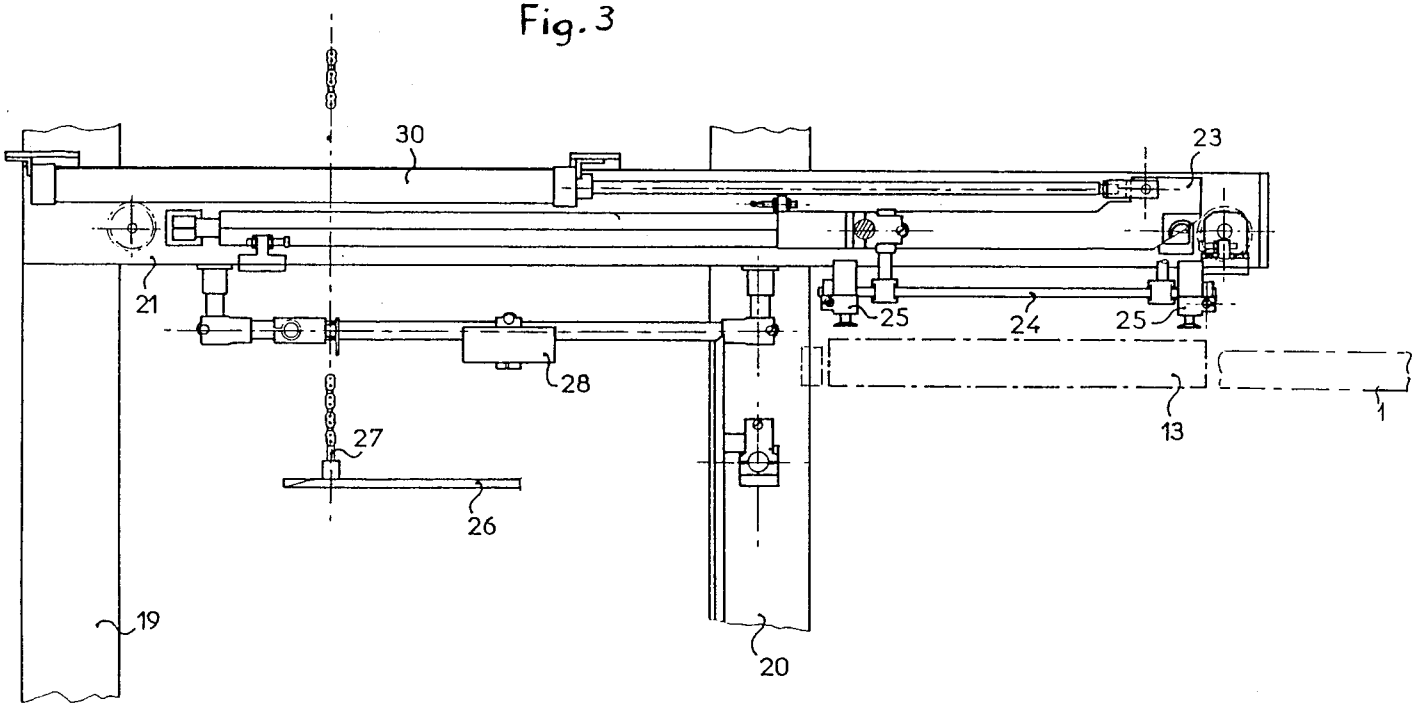
FIG. 3 is a partial side view in elevation, showing details of a receiving station for assembled blanks (which is very similar to the feeding station for the cardboard sheets)
Figure 4:
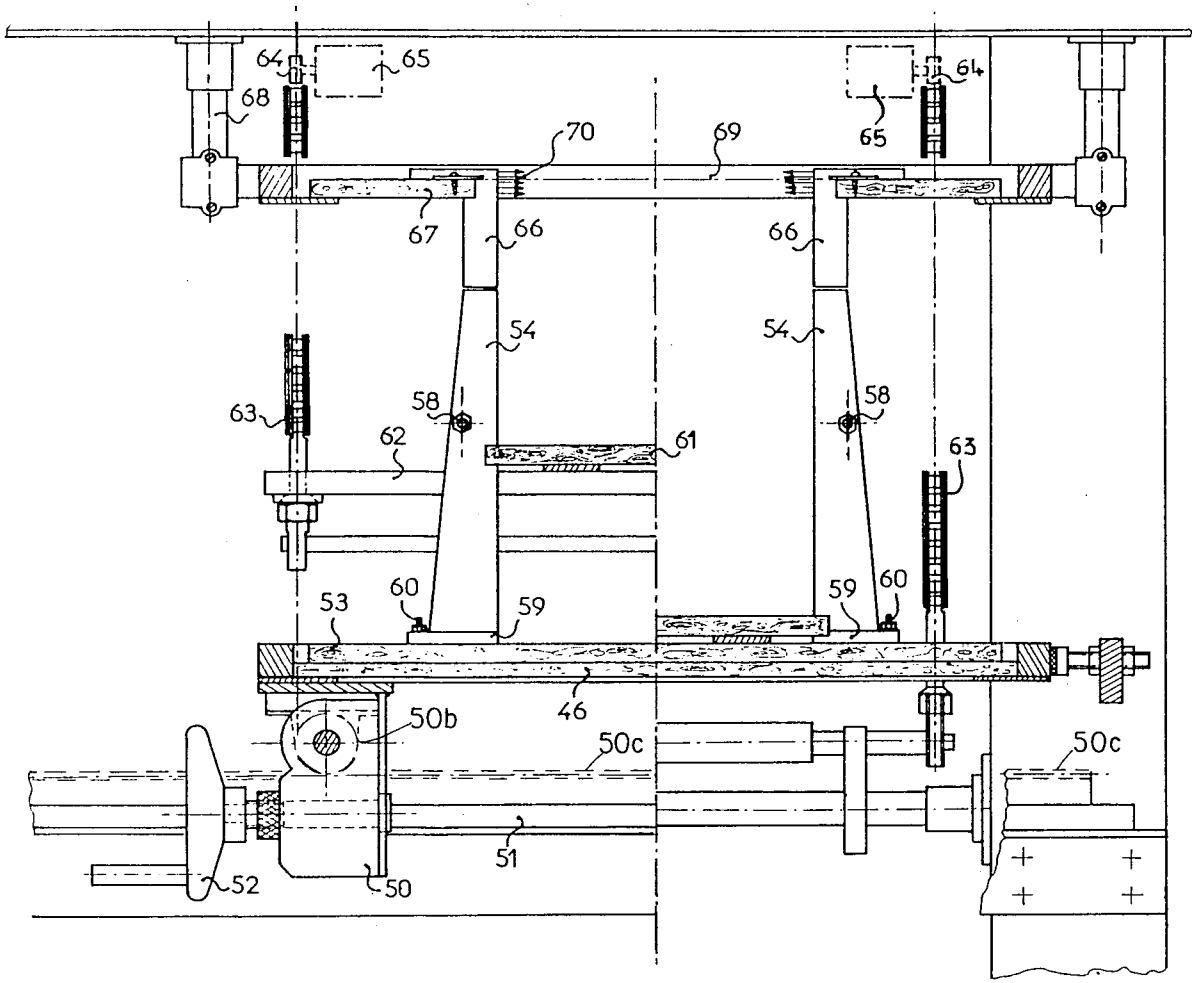
FIG. 4 is a frontal and partially lateral elevational view of the feeding station of the plastic blanks.
Figure 5:
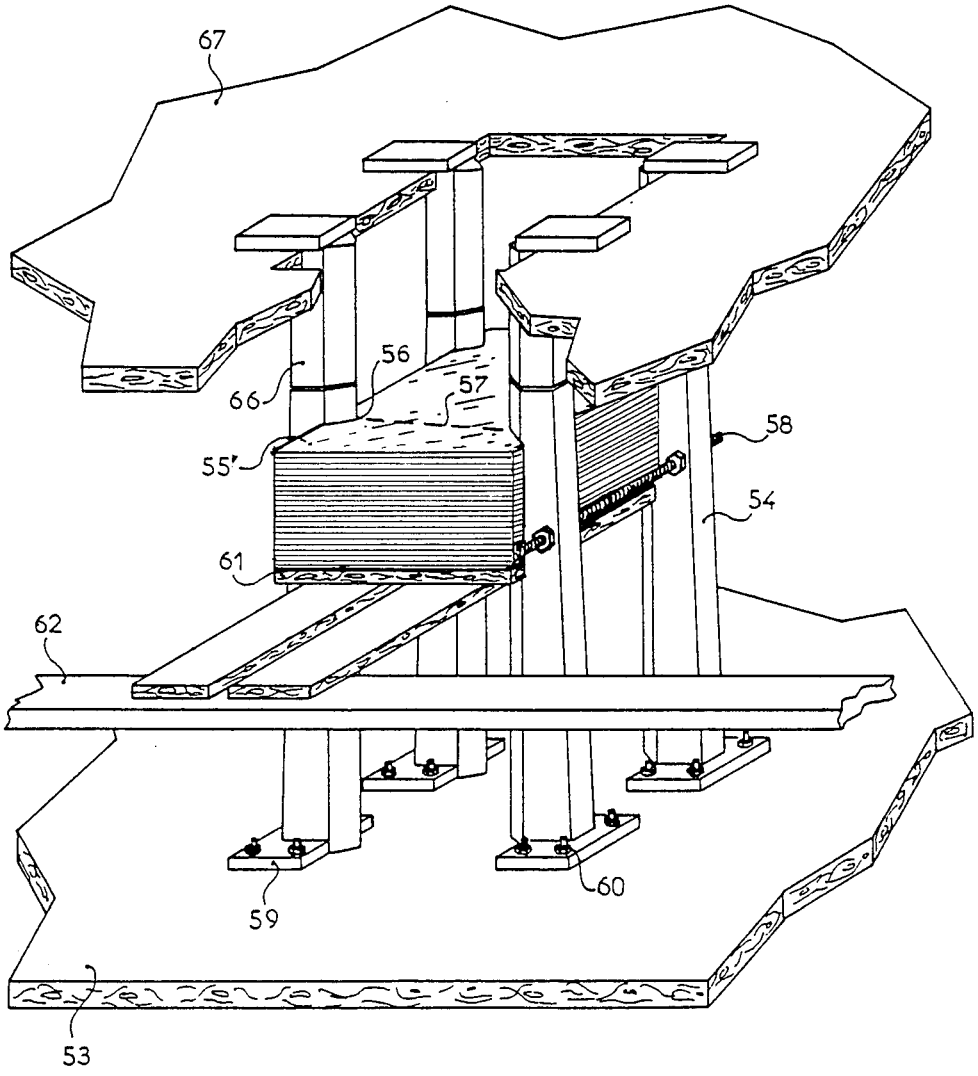
FIG. 5 is a perspective view of the guiding means of the station shown in FIG. 4.

Each of the work stations 2, 3 and 7 includes the general structure which is shown somewhat schematically in FIG. 2. A portion of the receiving station 7 is shown at FIG. 3, and portions of the feeding station 3 for the plastic blanks are shown at FIGS. 4 and 5.

Each station 2, 3 and 7 comprises radially outwardly of the circular plate 1 a structure which is formed of vertical posts 19, 20 (FIG. 3) carrying horizontal rails 21, 22 (FIGS. 2 and 3) whose separation corresponds substantially to the length of each of the suction boxes 8 to 13. The rails 21, extend above and over the circular plate 1 to the radial inner ends of the suction boxes, as shown at FIG. 3 for suction box 13, and at FIG. 2 for suction box 8. On the rails 21, 22 a movable frame 23 is mounted which comprises crossbars 24 on which suction pick-up heads 25 are mounted. The frame 23 can be advanced to a position in which it is above a suction box, for example, the suction box 13 as shown in FIG. 3 (or the suction box 8, as shown at FIG. 2), and withdrawn to a second position in which it is radially outwardly of the perimeter of the plate or table 1. In the region radially outwardly of the plate 1, structure including posts 19, 20, has a removable feeding or receiving plate 26 which can be moved vertically and which is controlled by chain driving means, not shown. In FIG. 3 one of connecting points 27 can be seen for attaching a chain of this device. In the region of the feeding or receiving plate 26, the rails 21, 22 have known margin setters, formed, for example, by adjustable stops 28, 29.

The suction pick-up heads 25 are connected by flexible conduits with a vacuum source (not shown). Known control means are provided to connect or cut off the suction heads 25 from this vacuum source. The frame 23 which carries the crossbars 24 with the suction pick-up heads 25 is moved radially of plate 1 by a double-action jack or cylinder 30 in FIG. 3.

Figure 6:
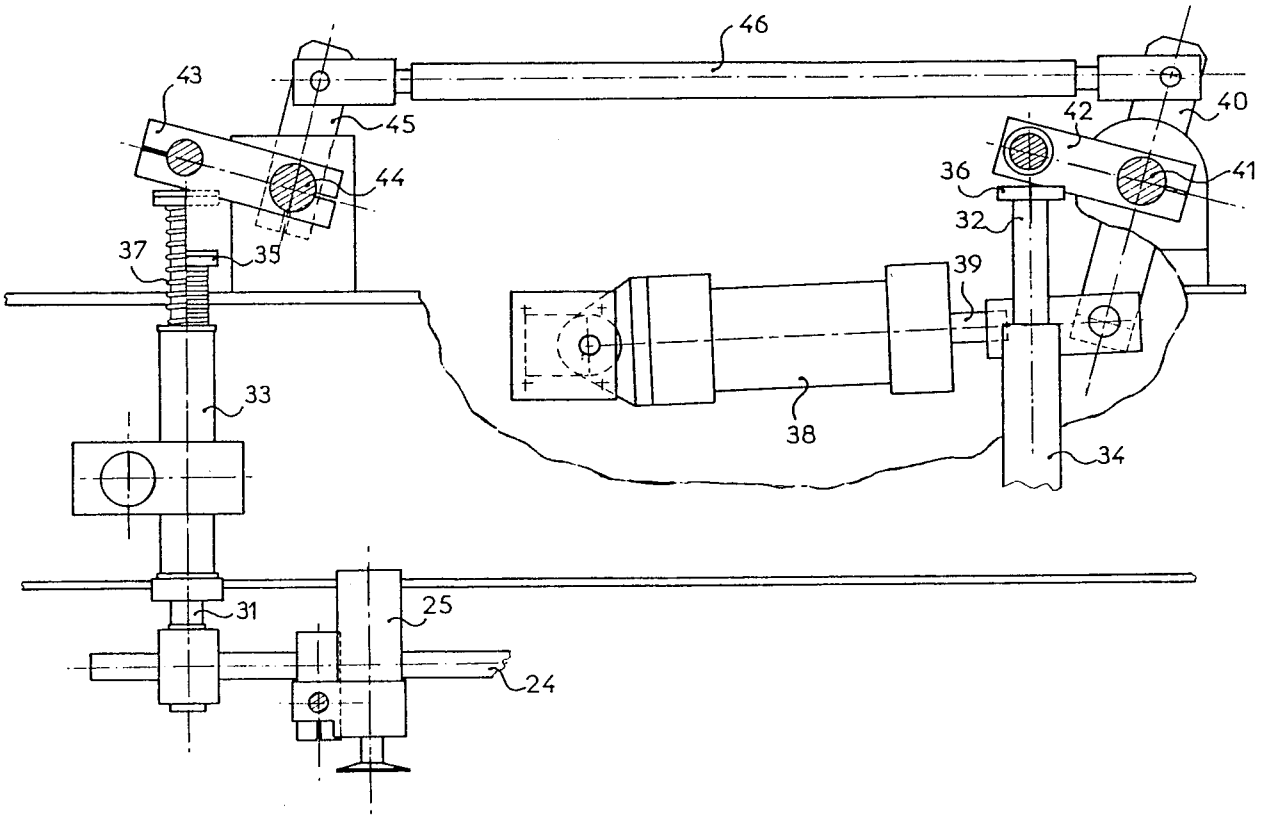
FIG. 6 is an elevational view of the control means for the suction heads of the different stations shown in FIGS. 2 to 4.

The frame 23 and the suction pick-up heads 25 can be lowered and raised to pick up or deposit a cardboard blank or a plastic blank (depending on the station). The means controlling these movements are shown in more detail in FIG. 6. In this figure a suction head 25 can be seen which is mounted on a crossbar 24 which, in turn, is connected near its ends to vertical slide rods 31, 32, extending upwardly respectively through spaced apart tubular guides 33, 34 which are fixed to the structure. At its upper end each slide rod 31, 32 comprises a larger head 35, 36 which serves as a stop or seat for a helical compression spring 37, provided on each rod between the enlarged head and the upper end of the respective guides 33, 34. Springs 37 normally urge rods 31, 32 and thus each suction pick-up head 25 to the upper position shown at FIG. 6. For controlling the lowering of the suction heads 25, a jack or cylinder 38 is provided on the structure whose rod 39 is connected at its free end to the lower end of a double ended lever 40. This lever 40 is fixed on a pivot shaft 41 on which is also fixed a lever 42. An end of the lever 42 is above the slide rod 32. Above the slide rod 31, is an end of another lever 43 which is fixed on a pivot shaft 44 on which is also fixed a lever 45. A connecting rod 46 extends between and is pivotally connected to the upper ends of the respective levers 40 and 45.

When the cylinder 38 is actuated, its rod 39 extends and causes the lever 40 to pivot counterclockwise, lever 45 being simultaneously pivoted by connecting rod 46. The levers 42 and 43 push the slide rods 31, 32 downwardly against the bias of the springs 37. The suction heads 25 are thus lowered for lifting blanks from or depositing blanks on a suction box of the circular plate 1.

The arrangement at the feeding station 3 for the plastic blanks 55' is slightly different from the cardboard blank feeding station 2 and the assembled blank removing station 7 and comprises, in particular, means for the accurate guiding of the plastic blanks as shown in FIGS. 4 and 5.

The feeding device for plastic blanks includes suction heads for picking up and feeding plastic blanks which are like those for feeding cardboard blanks 2, but which are not shown in FIG. 4.

The station 3 shown in FIG. 4 comprises a receiving plate 46, corresponding to plate 26 of the stations 2 and 7. The plate 46 is mounted for lateral adjustment by a manual control unit comprising sliding angle gear unit 50, fixed on the lower surface of the plate 46 and which slides on shaft 51 which can be rotated by a wheel 52. A pinion 50*b* engages a rack 50*c*. Turning wheel 52, rotates pinion 50*b* to move the plate 46 to the right or left as shown at FIG. 4, by virtue of the gearing of gear unit 50.

The plate 46 is adapted to support a guide support plate 53 on which there are fixed a plurality of vertical guides 54 between which the plastic blanks 55' are placed as shown in FIG. 5. These blanks 55' have cut-outs 56 at the ends of their fold lines 57. These cut-outs 56 have a substantially truncated triangular shape and the guides 54 are arranged on the support plate 53 in such a manner as to engage the cut-outs 56 and have for this purpose a shape matching the shape of the cut-outs 56. Adjacent guides 54 are held securely in their intermediate portions by spacing rods 58. Each guide 54 has at its lower end a larger base 59 which allows it to be fixed by screws 60 to the plate 53. This arrangement is particularly simple and allows rapid changing of the guide means 54 on the support plate 53 in accordance with the dimension and configuration of the blanks 55'.

To facilitate the guiding of a stack of blanks 55', the lower portions of the guides 54 which engage the cut-outs 56 are slightly enlarged. In this manner, a blocking of the blanks between the guide means is avoided when they are moved upwardly. To cause this upward movement, the blanks 55' lie on a base 61 supported by small strips which extend between guides 54 and which are supported by a vertically movable control plate 62. The movement of plate 62 is controlled by chain transmission means which are shown in FIG. 4, with chains 63 being attached to the plate 62. The chains are driven by a gear 64 which is keyed on the shaft of a control motor 65.

Above the movable guides 54, an assembly of fixed guides 66 is provided which are supported by a plate 67, connected by arms 68 to the structure of the feeding station 3 for the plastic blanks. The guides 66 are aligned on the guides 54, and the plate 67 has an opening 69 for upward passage of the blanks 55'. To avoid sticking of the uppermost blanks 55' on the pile of blanks lying on the base 61, the fixed guides 66 have at their upper ends openings through which compressed air is blown as indicated at 70. This arrangement assures that the suction heads of this station pick up only a single blank 55' from the top of the stack in each operating cycle.

The structure of the different suction boxes 9 to 13 of the circular plate 1 is shown in detail in FIGS. 7, 8 and 9. Each box, such as the box 9, in FIG. 7, has a rectangular case which is divided by vertical walls 71 into a plurality of compartments 72, communicating with each other and being connected, as shown in FIG. 1, by flexible conduits 14 and valves 15 to a vacuum source 17. The upper surface of each box is closed by a metal sheet 73 having many perforations 74 which assure suction gripping of the cardboard blanks 55 and the plastic blanks 55' placed on the box.

The boxes are fixed to the plate 1 by bearings 75, 76 and 77 having considerable play, whereas the bearing 78 has only a limited play. The structure of the bearings 76, 76 and 77 is shown in FIG. 9, whereas the structure of the bearing 78 which is different, is shown in FIG. 8. The particular structure of these bearings has proved to be necessary to attain proper sealing pressure and hot grooving by high frequency radiation at station 5. At this station the boxes are subjected by the high frequency press (FIG. 9) to heating which produces an expansion of the material from which the boxes are made (especially aluminum), with expansion being sufficiently great to endanger the positioning of the boxes and their vertical movement, and consequently the positioning of the cardboard blanks and the plastic blanks with respect to the sealing and/or hot grooving tools of the high frequency press. These tools are not shown and described here because they correspond to tools described in detail in the Applicant's U.S. application Ser. No. 329,335 cited above.

To compensate for this expansion and thus to assure a sealing and/or grooving at high accuracy, the boxes must be mounted for slight movement horizonatally in two directions. Furthermore, to equalize the pressure on the entire surface of each box between the fixed jaw 89 and the movable jaw 90 of the high frequency press (FIG. 10), the boxes must be movable vertically relative to the circular plate 1.

Each bearing 75 to 77 (FIG. 9) comprises on a lug 79, provided at the corners of the box, a vertical passage 80 in which a cap 81 is arranged which carries an elastic bushing 82. The cap 81 has a cylindrical lower body portion 83 and a conical extreme upper portion 84. Between the vertical portions of the cap 81 and body 83, and the lug 79 are gaps 80 and j which provide clearance spaces. A vertical pin 85, fixed to circular plate 1 extends through bushings 82 and cap 81. This pin has a lower cylindrical portion 86 and a conical extreme upper portion 87. Between the plate 1 and the lugs 79 is a helical spring 88 on the pin 85, which normally maintains the suction box 9 at a predetermined distance above the plate 1. In this upper position, the conical portion 87 of the pin 85 cooperates with the conical portion 84 of the cap 81 and the box is immobilized and held in a predetermined central position. It is kept in this position when it is opposite the work stations 2, 3, 4, 6 and 7.

On the other hand, where the box is moved between the fixed jaw 89 and the movable jaw 90 of the high frequency sealing and grooving press 91 (FIG. 10) of the station 5, and the press is actuated, the movable jaw 90 pushes the box 9 against the bias of the springs 88 (shown at FIGS. 8 and 9) onto the fixed jaw 89. At this time the conical portion 87 of the pin 85 is disengaged from the conical portion 81 of the cap 80. In this manner a certain play is created between the box and the pins 85, i.e. with respect to the plate 1. The box 9 can thus be moved perfectly parallel to the jaws 89, 90 of the press 91. This is absolutely necessary for attaining a good sealing and/or grooving of the plastic blank 55', because these operations are a function of the strength of the press, the pressure exerted upon the blanks 55 and 55' between the two jaws 89, 90, and the duration of pressing of the jaws of the press.

The bearing 78 (FIGS. 7 and 8) has substantially the same structure as the bearings 75 to 77. But in this case no play is provided between the body 83 and the lug 79. In addition, the head of the cap has a polygonal cross-section as shown in FIG. 7.

To avoid damage to the press 91, there is a cam 93 (FIG. 10) secured to the plate 1 between each pair of adjacent suction boxes. Cam 93 cooperates with a stationary switch 94, electrically connected in the control circuit of the press 91. The switch 94 is actuated only in a completely indexed position of plate 1 and triggers the descent of the press. If during the course of the descent of the movable jaw 90 of the press, an accidental disorientation of the plate 1 should occur, the movable jaw is automatically returned to its upper normal position.

To avoid interactions between the electrical circuits of the press 91 and the control means of the plate 1, the starting of the two elements is controlled by hydraulic and optical means, respectively.

FIG. 11 shows schematically the circuit of the start-up control 102 of the plate 1. Two valves 95, 96 are provided on the press and are connected to a source of compressed air 97. The valves have contact arms 103, 104 which are actuated by the movable jaw 90 when it is in its upper position. The valves 95, 96 thus actuate two pressostats (air operated stitches) 98, 99 which supply current to a starting circuit 101. The starting signal supplied by this circuit 101 is applied to the start-up control 102 for the plate 1. The plate 1 can therefore advance or index only when the movable jaw of the press is in its upper position.

The starting of the press occurs via an electronic-optical isolator (FIG. 12), comprising a current source 105 which energizes a lamp 106 which is arranged at one end of a light guide 107. At the other end of this guide a photoelectrical cell 108 is arranged which supplies via an amplifier 109 the current for the starting circuit 110 of the press.

Figure 13:
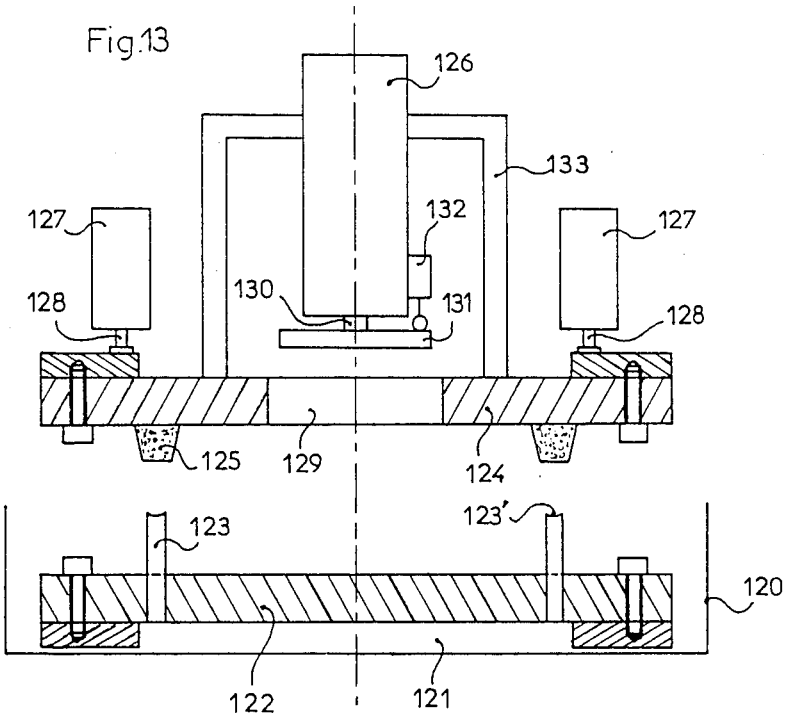
FIG. 13 is a schematic, vertical, sectional view showing the upper frame of the coating means in its position above the lower frame of the coating means.
Figure 14:
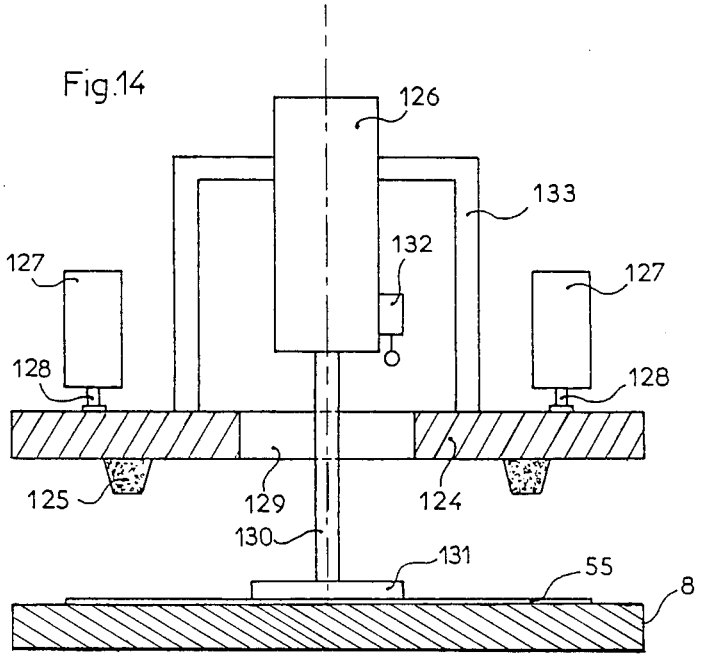
FIG. 14 is a schematic, vertical, sectional view of the apparatus of FIG. 13 showing the upper frame in position above a suction box on the table.

The coating device according to the present invention which is shown in FIGS. 13 and 14, comprises a container 120 held at a constant level, positioned radially outwardly the circular plate 1 of the device and in radial alignment with a suction box thereof. The container 120 holds a coating liquid 121, facilitating the high frequency sealing between the cardboard blanks and the blanks of a stiff plastic. Such a substance can be a vinyl glue or preferably an aqueous dispersion of polyacrylic esters, such as the one sold under the name "Acronal 300 D" by the company BASF.

In the container 120 is a vertically movable lower frame 122 which has on its upper surface, fibers 123 having at their upper ends gutters 123'. The pattern of the fibers 123 corresponds to that of the sealing lines to be formed between the blanks.

In a lowered position of the lower frame 122, the upper ends of the fibers 123 are below the level of the coating liquid in the container so that the gutters 123' are filled with the liquid. In the upper position of frame 122 the fibers 123 are above the liquid level in the container 120.

The upper frame 124 of the coating device comprises on its lower surface bands or strips 125 of an absorbing material whose pattern corresponds to that of the fibers 12 of the lower frame 22 and thus to the sealing lines which are to be formed.

The upper frame 124 comprises control means for moving the frame 24 vertically between two operational positions. These means are shown as two cylinders 127 whose shafts 128 are fixed to the frame 124. Furthermore the upper frame 124 has a central opening 129 above which a cylinder 126 is arranged whose shaft 130 carries at its free end a plate or shoe 131 of plastic material to hold the blank 55 or 55' to be coated on the suction box 1. The cylinder 126 also has an end of stroke stitch 132, actuated by the shoe 131 when it is moved to its upper position. The frame 124 is supported by a transfer carriage, not shown here, which moves it in a horizontal direction between an outer position in which it is in alignment above the lower frame 122 and an inner postion in which it is above the suction box 8. This transfer carriage is of the type described for the feeding stations for the blanks.

The coating device according to the invention operates as follows:

At the start of a coating cycle, the lower frame 122 is moved from a submerged position in the liquid in the container 120 to its upper postion, at which time the upper frame 124 has in its upper, outer position above the frame 122. The cylinders 127 are actuated to lower the frame 124 until the stripes 125 thereof engage the ribers 123 of the lower frame 122 and thus pick up the coating liquid continaed in the gutters 123'. Thereafter, the upper frame 124 is lifted by the cylinders 126 and is then moved horizontally by the transfer carriage (not shown) to an inner position above the suction box 8 carrying a blank to be coated, whereas the lower frame 122 is moved down into its lower submerged position to recharge the gutters 123' with the coating liquid 121.

In the radially inner position of the frame 124 the cylinders 127 lower the frame 124 and the cylinder 126 lowers shoe 131 to clamp a blank 55 or 55' against the suction box 8. In this position the stripes 125 deposit a pattern of coating liquid onto the blank. The upper frame 124 is then lifted by the cylinders 127, whereas the shoe 131 remains pressed against the blank to avoid any movement of the blank relative to the suction box when the frame 124 is lifted.

When the frame 124 arrives at its upper position, the shoe 131 is returned to its upper position and actuates the switch 132, at the end of its return stroke, which actuates the carriage to return the upper frame 124 to its outer position above the lower frame 122. The lower frame is moved into its upper position and a new work cycle can begin, with the table 1 having been indexed or moved one step in the meantime.

According to a preferred embodiment, the coating liquid contains a copolymer of polyvinyl acetate in aqueous dispersion with 5% solvent.

I claim:

1. Apparatus for assembling paperboard and plastic blanks, particularly for making packages of the type having an opening which is closed by a stiff sheet of plastic, comprising in combination:

a horizontal table which is indexable around a vertical axis; a plurality of suction boxes adapted to receive the blanks to be assembled, means mounting said suction boxes on said table in predetermined angular positions; means for connecting each suction box to a vacuum source;

a plurality of work stations arranged around said table in predetermined spaced apart angular positions, said work stations comprising a feeding station for feeding a paperboard blank onto a suction box, a feeding station for feeding a plastic blank onto a suction box, a sealing station for sealing a plastic blank on a suction box to a paperboard blank on the same suction box, and a discharge station for removing assembled blanks for the suction boxes; and control means for intermittently indexing said table to move said suction boxes successivley from one work station to the next and for operating each of said stations, after indexing movement of said table.

2. Apparatus according to claim 1 wherein said feeding stations for the paperboard blanks and plastic blanks each comprise: a structure positioned radially of said table, a vertically movable support mounted on said structure and which is adapted to receive said blanks, a generally radially movable frame above said support, means for moving said frame between a first radial position above said table and a second radial position above a suction box on said table, a plurality of suction heads mounted on said movable frame and connected to a vacuum source; control means for moving said suction heads to lowered positions for picking up blanks and depositing the blanks, and to an elevated position for transfer movement of said frame between said first and second radial positions.

3. Apparatus according to claim 2 wherein said feeding station for feeding plastic blanks further comprises a removable guide assembly comprising a plurality of vertical guides between which said blanks are placed, wherein said plastic blanks each have lateral cut-outs, and said vertical guides guide said plastic blanks along their cut-outs, a fixed plate above said vertically movable support and below said movable frame carrying said suction heads, a plurality of guides secured to and projecting downwardly from said fixed plate and whose section and arrangement correspond to said vertical guides, said fixed plate having an opening to enable upward lifting of the plastic blanks by said suction heads.

4. Apparatus according to claim 3 wherein said guides fixed to said plate comprise near upper ends thereof, on their guiding surfaces, a plurality of apertures connected to a source of compressed air, for separating upper blanks of a stack of the blanks.

5. Apparatus according to claim 2 wherein said sealing station comprises a press having a fixed jaw on one side of said table and a movable jaw on the other side of said table, said means mounting said suction boxes on said table comprise means supporting said boxes on said plate for vertical movement, spring means for maintaining the boxes at a predetermined distance above the table, said table having opening therein aligned with the respective boxes to enable each box to be moved under the action of the movable jaw of the press into engagement with the fixed jaw.

6. Apparatus according to claim 5, wherein said means mounting said boxes for vertical movement comprise bearings and posts, a deformable elastic joint between said bearings and posts, and conical upper portions of said posts cooperate with conical portions of said bearing when a box is in its upper position, and are disengaged from each other when the box has been moved by the movable jaw against the action of the spring means.

7. Apparatus according to claim 5 wherein said press of the sealing station is actuated by means of an electronic-optical barrier.

8. Apparatus according to claim 5 wherein said press comprises two valves between a source of compressed air and two air pressure actuated switches in series with a control circuit of said press, said valves being moved into positions to close said air pressure actuated switch by the movable press jaw in its upper position.

9. Apparatus according to claim 5 further comprising a cam on said table between each pair of adjacent boxes and a switch in the control circuit of the press actuable by said cam for displacing movable jaw of the press to a retracted position.

10. Apparatus according to claim 1 further comprising, at a blank feeding station, means to apply to a blank a liquid for promoting sealing of the blanks at said sealing station along predetermined sealing lines.

11. Apparatus according to claim 10 wherein said means to apply the liquid comprises means to apply an aqueous dispersion of a polyacrylic base ester.

* * * * *